US011946395B2

(12) United States Patent
Barve et al.

(10) Patent No.: US 11,946,395 B2
(45) Date of Patent: Apr. 2, 2024

(54) VARIABLE CAM TIMING PHASER

(71) Applicant: BorgWarner Inc., Auburn Hills, MI (US)

(72) Inventors: Anand Barve, Lansing, NY (US); Timothy Wilton Kunz, Rochester, NY (US)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 18/107,957

(22) Filed: Feb. 9, 2023

(65) Prior Publication Data

US 2023/0258109 A1 Aug. 17, 2023

Related U.S. Application Data

(60) Provisional application No. 63/309,315, filed on Feb. 11, 2022.

(51) Int. Cl.
*F01L 1/344* (2006.01)

(52) U.S. Cl.
CPC ... *F01L 1/3442* (2013.01); *F01L 2001/34426* (2013.01)

(58) Field of Classification Search
CPC ..... F01L 1/3442; F01L 2001/34426; F01L 2001/3443; F01L 2001/34433; F01L 1/34409
USPC ..... 123/90.15, 90.17, 90.31
See application file for complete search history.

(56) References Cited

U.S. PATENT DOCUMENTS 6,263,843 B1 * 7/2001 Todo ..... F01L 1/344 123/90.17
7,703,426 B2 4/2010 Weber
2012/0000437 A1 * 1/2012 Ozawa ..... F01L 1/3442 123/90.15

FOREIGN PATENT DOCUMENTS

DE 102012209915 B4 6/2021
EP 2305969 B1 6/2012

OTHER PUBLICATIONS

English language abstract and machine-assisted English translation for DE 10 2012 209 915 B4 extracted from espacenet.com database on Feb. 13, 2023, 12 pages.

* cited by examiner

*Primary Examiner* — J. Todd Newton
(74) *Attorney, Agent, or Firm* — Howard & Howard Attorneys PLLC

(57) ABSTRACT

A variable cam timing phaser includes a housing disposed about an axis and having an inner housing surface defining a housing interior. The variable cam timing phaser includes a rotor moveable between an advance position and a retard position. The rotor includes a hub and a vane, with the rotor and the housing defining a chamber. The vane further defines the chamber into an advance chamber and a retard chamber. The variable cam timing phaser also includes a control valve assembly including a valve housing and a control piston. The variable cam timing phaser also includes a chamber biasing assembly disposed in one of the advance and the retard chambers and configured to bias the rotor into a predetermined position between the advance and the retard positions. The chamber biasing assembly includes a chamber piston, a chamber biasing member, and a chamber check valve.

20 Claims, 15 Drawing Sheets

VARIABLE CAM TIMING PHASER

CROSS-REFERENCE TO RELATED APPLICATIONS

The subject patent application claims priority to and all of the benefits of U.S. Provisional Patent Application No. 63/309,315, filed on Feb. 11, 2022, the disclosure of which is hereby incorporated by reference.

BACKGROUND OF THE INVENTION

1. Field of the Invention

The present invention generally relates to a variable cam timing phaser and, more specifically, to a variable cam timing phaser of a variable cam timing system.

2. Description of the Related Art

Conventional variable cam timing systems include a camshaft and a variable cam timing phaser, with the variable cam timing phaser including a housing, a rotor, and a control valve assembly. Conventional control valve assemblies include a valve housing engageable with the camshaft to fix the valve housing to the camshaft or to fix a variable cam timing phaser to the camshaft, and a piston disposed within the valve housing to control a flow of hydraulic fluid to cause rotation of the rotor with respect to the housing to adjust timing of the camshaft.

In recent years, there has been an increased demand for vehicles including internal combustion engines to have reduced emissions, particularly during start-up of the internal combustion engine. As such, there remains a need for a variable cam timing phaser and variable cam timing system including the same that reduces emissions during start-up of the internal combustion engine.

SUMMARY OF THE INVENTION

A variable cam timing phaser of a variable cam timing system including a camshaft includes a housing disposed about an axis and having an inner housing surface defining a housing interior. The variable cam timing phaser includes a rotor at least partially disposed within the housing interior and moveable with respect to the housing between an advance position and a retard position different from the advance position. The rotor includes a hub and a vane extending from the hub away from the axis toward the inner housing surface, with the rotor and the housing defining a chamber that is fillable with hydraulic fluid for rotating the rotor about the axis with respect to the housing between the advance and retard positions. The vane is disposed in the chamber and further defines the chamber into an advance chamber and a retard chamber. The variable cam timing phaser also includes a control valve assembly including a valve housing defining a valve housing interior, and a control piston disposed in the valve housing interior and moveable between at least a first and second position with respect to the valve housing to control a flow of hydraulic fluid through the valve housing interior. The variable cam timing phaser also includes a chamber biasing assembly disposed in one of the advance and the retard chambers and configured to bias the rotor into a predetermined position between the advance and the retard positions. The chamber biasing assembly includes a chamber piston, a chamber biasing member, and a chamber check valve.

As such, the variable cam timing phaser including the chamber biasing assembly helps reduce emissions during start-up of an internal combustion engine.

BRIEF DESCRIPTION OF THE DRAWINGS

Other advantages of the present invention will readily be appreciated, as the same becomes better understood by reference to the following detailed description when considered in connection with the accompanying drawings.

DETAILED DESCRIPTION OF THE INVENTION

Figure 1:
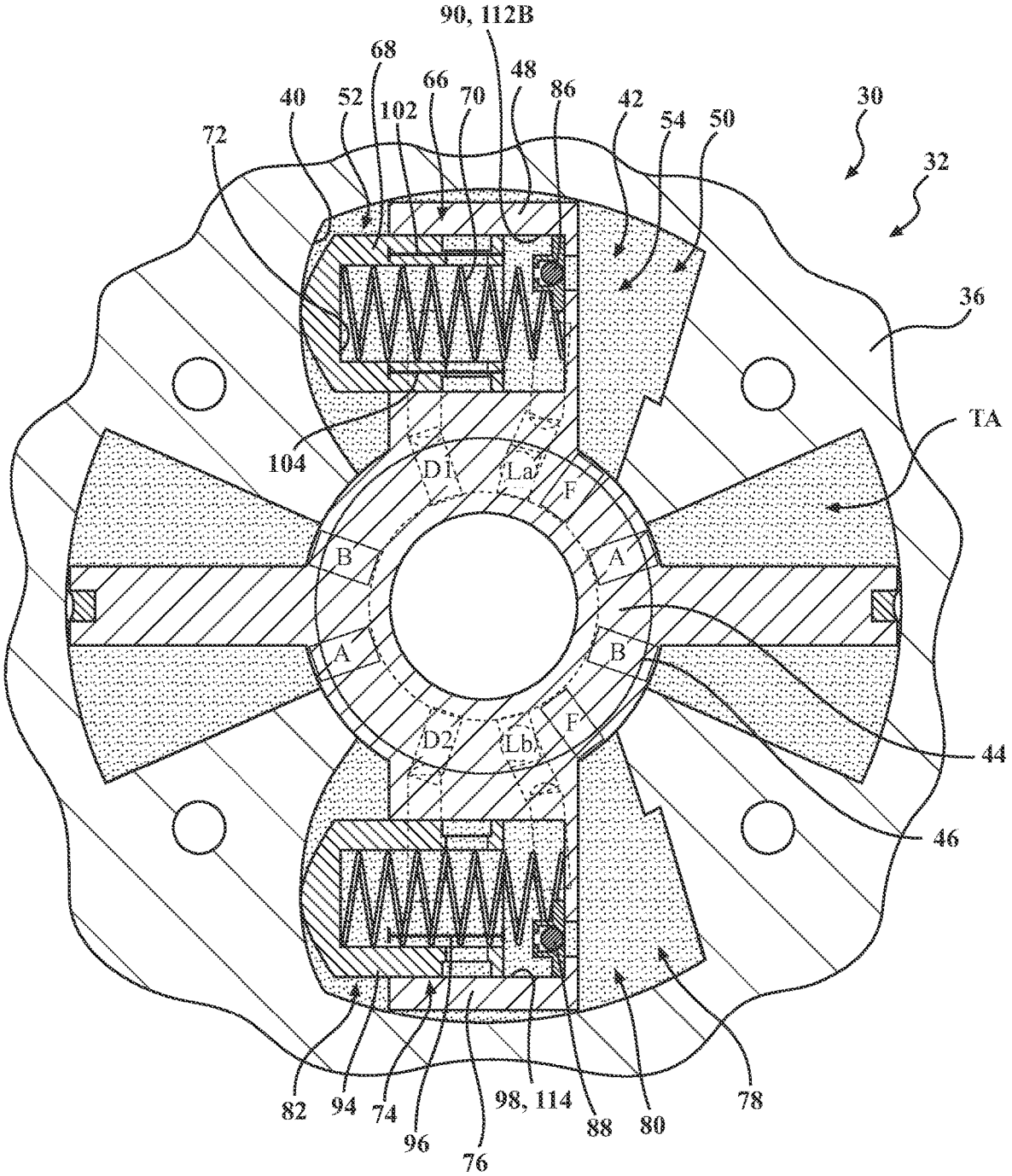
FIG. 1 is a cross-sectional view of a variable cam timing phaser including a housing, a rotor, and a chamber biasing assembly.
Figure 2:
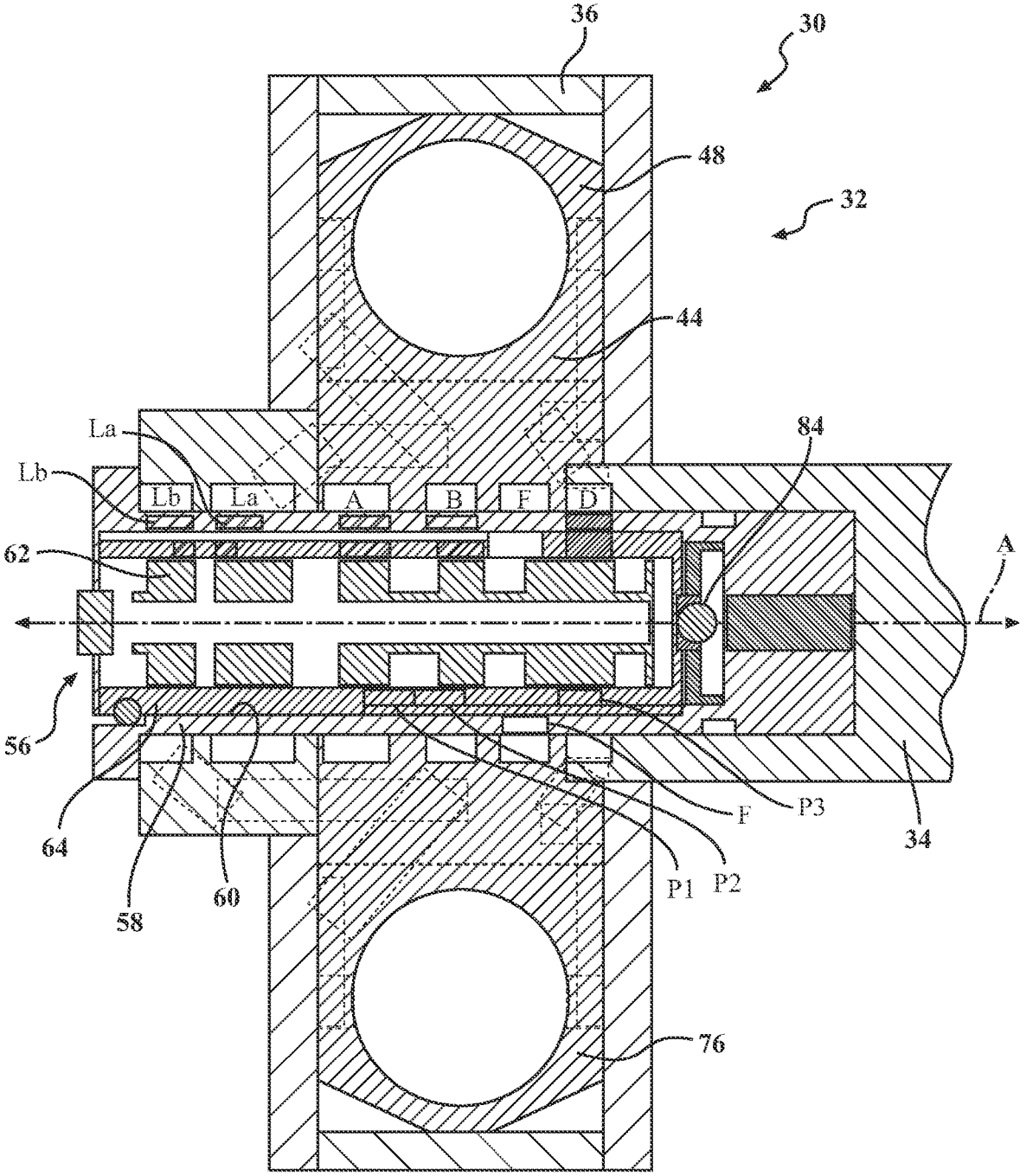
FIG. 2 is a cross-sectional view of a variable cam timing system including a camshaft and the variable cam timing phaser including a control valve assembly.
Figure 3:
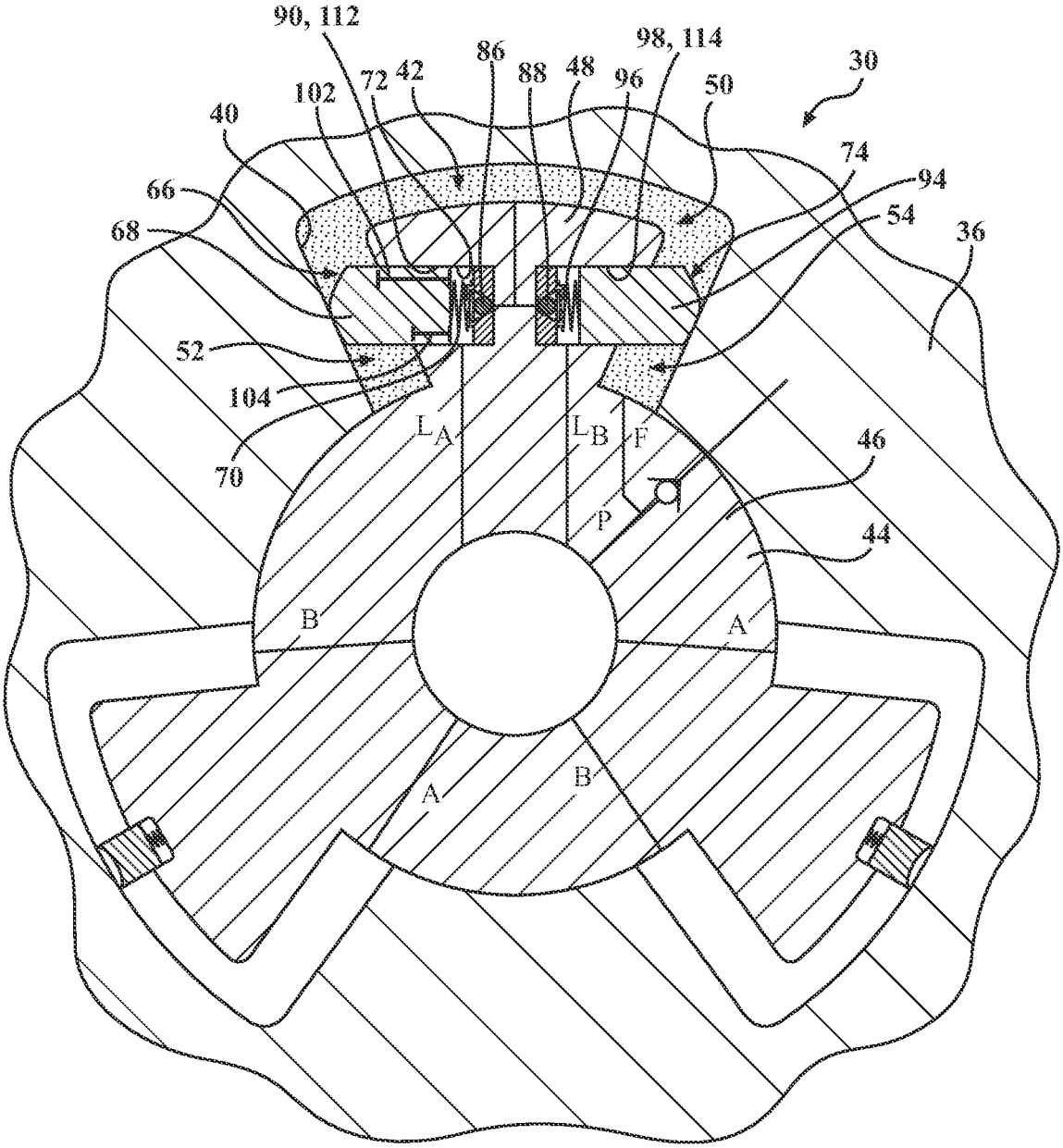
FIG. 3 is a cross-sectional view of another embodiment of the variable cam timing phaser.
Figure 4:
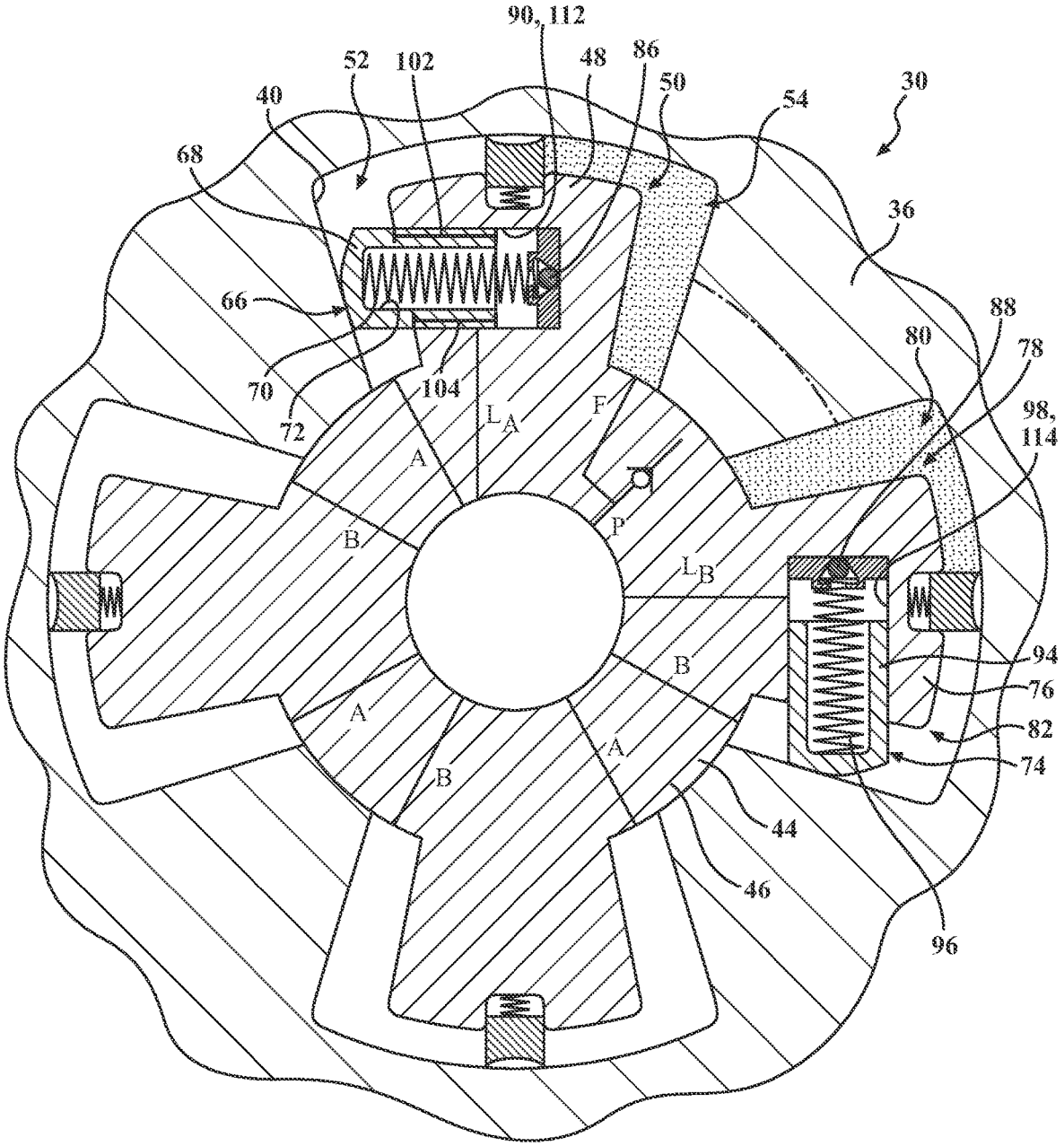
FIG. 4 is a cross-sectional view of another embodiment of the variable cam timing phaser.
Figure 5:
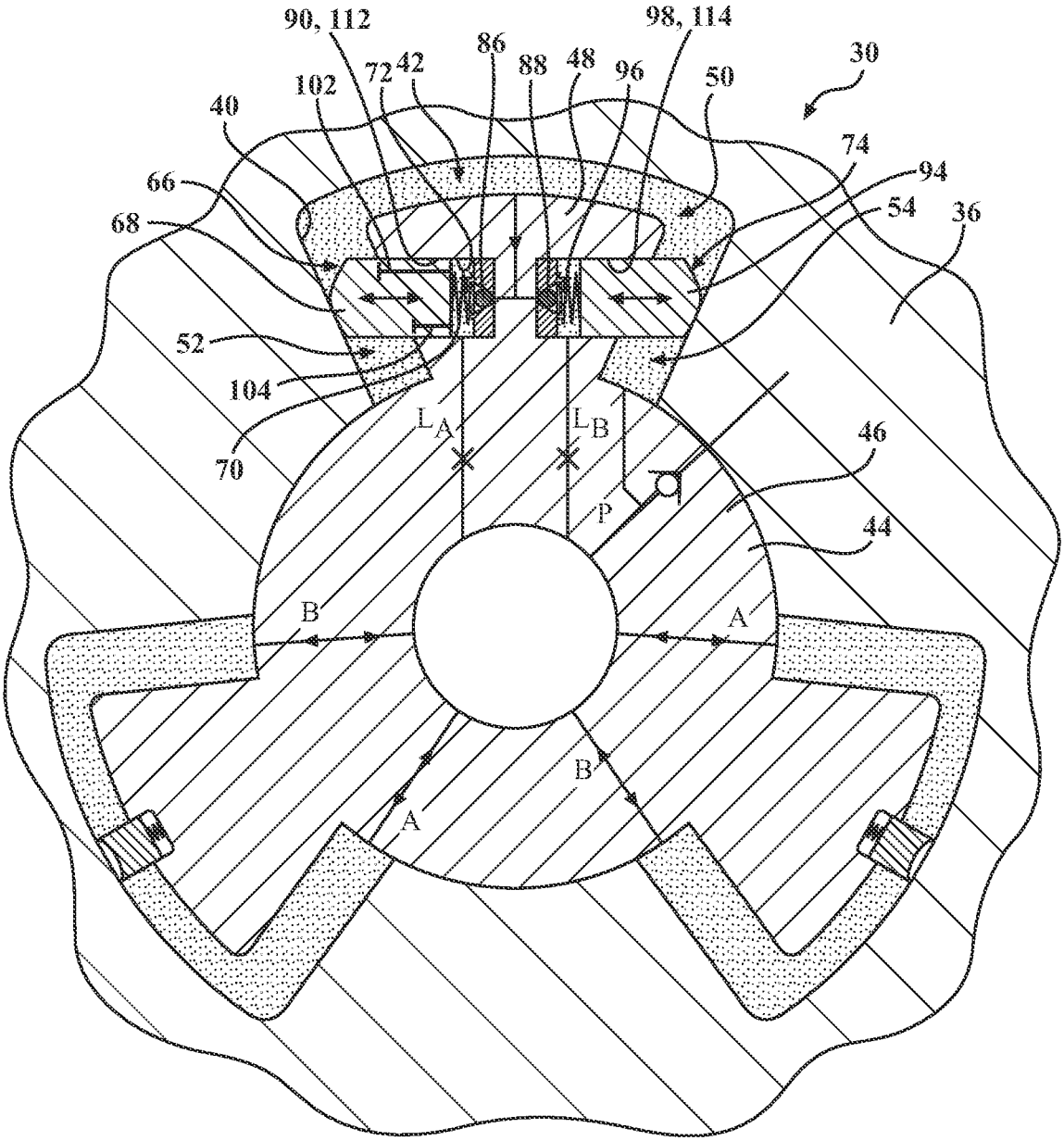
FIG. 5 is a cross-sectional view of another embodiment of the variable cam timing phaser of FIG. 3 including another embodiment of the chamber biasing assembly and a second chamber biasing assembly, and illustrating a holding position of the rotor.
Figure 6:
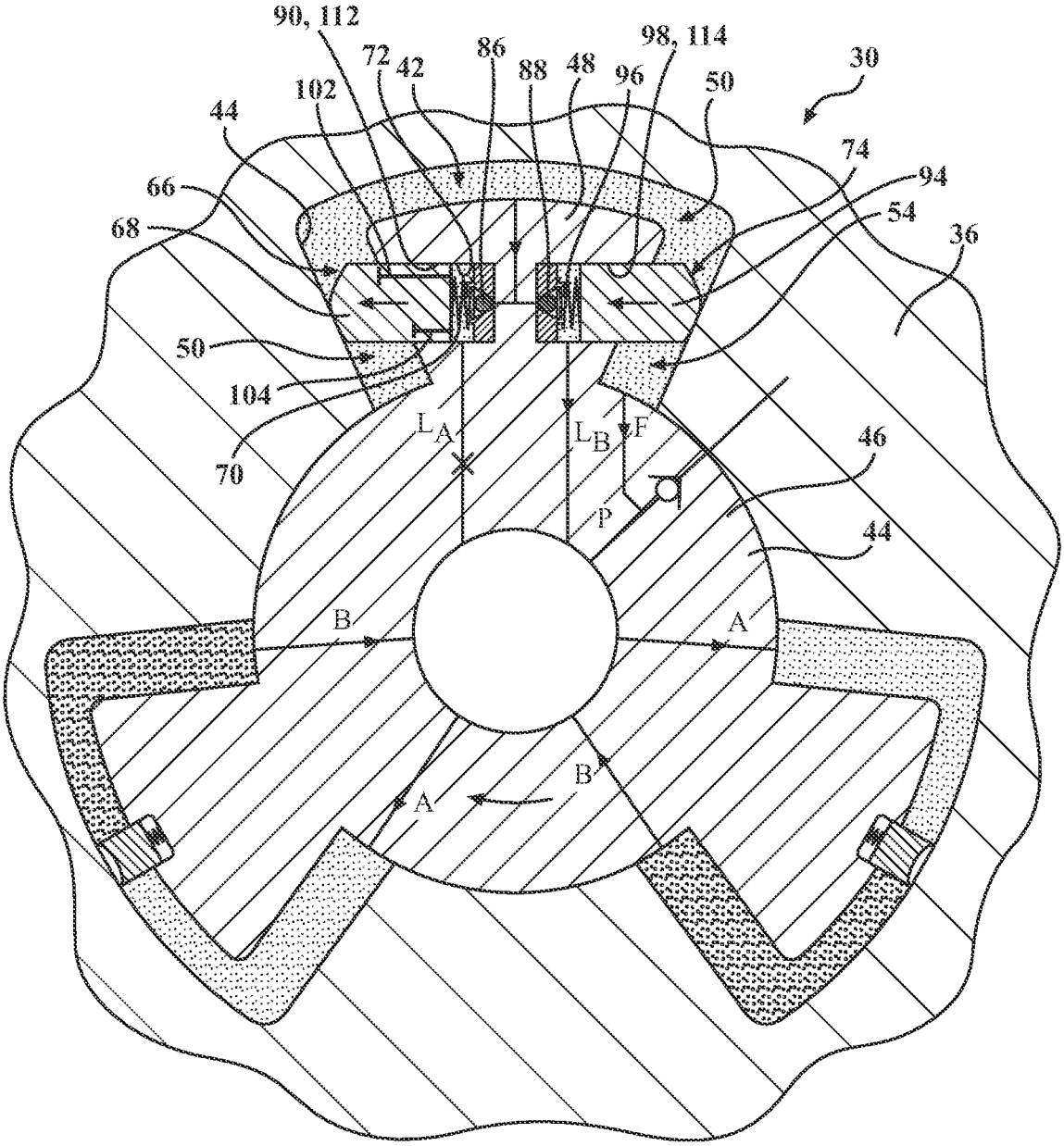
FIG. 6 is a cross-sectional view of the variable cam timing phaser of FIG. 3, with the rotor moving toward the advance position.
Figure 7:
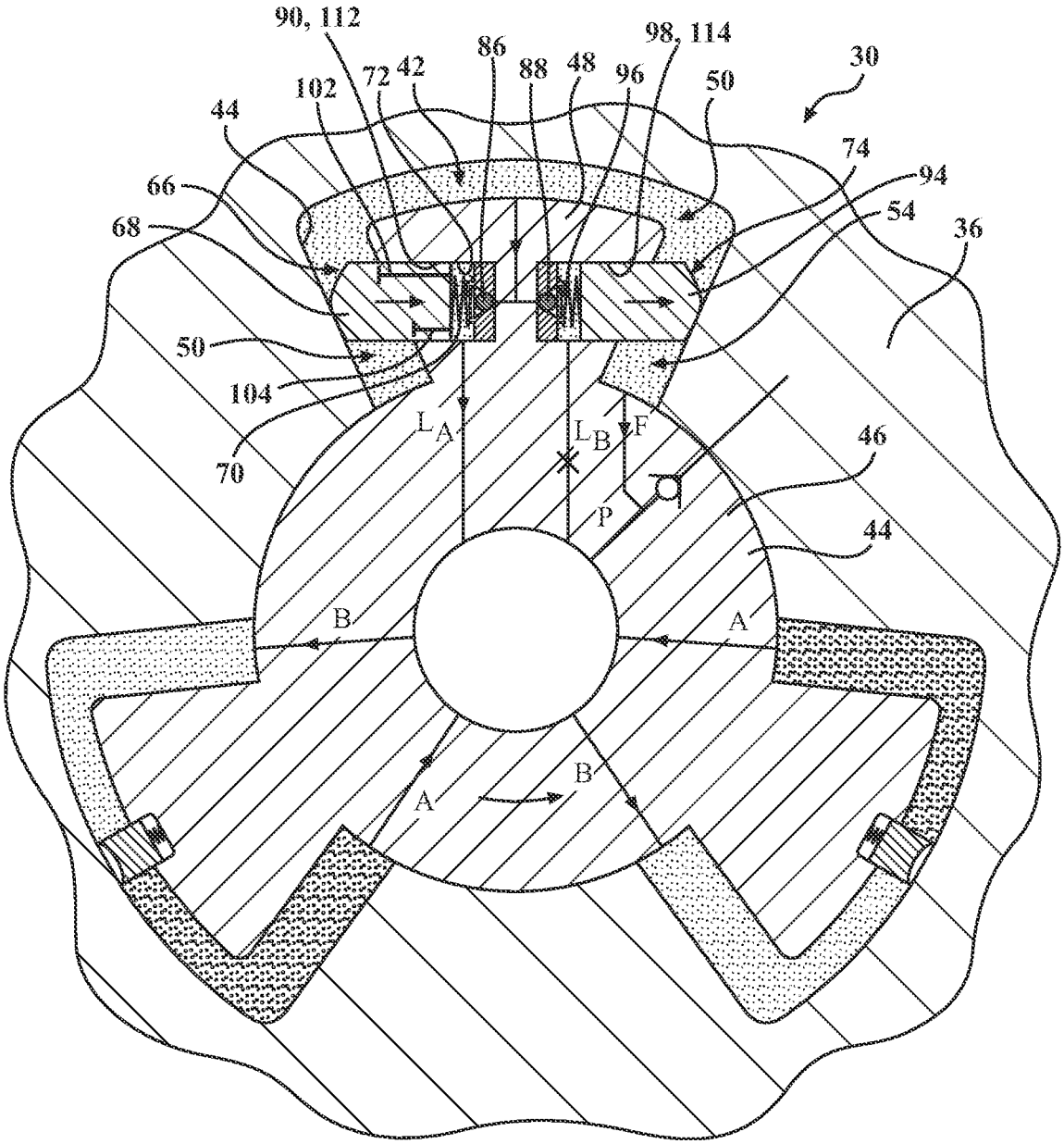
FIG. 7 is a cross-sectional view of the variable cam timing phaser of FIG. 3, with the rotor moving toward the retard position.

With reference to the Figures, wherein like numerals indicate like parts throughout the several views, a variable cam timing phaser 30 of a variable cam timing system 32 is generally shown in FIGS. 1 and 2. The variable cam timing system 32 includes a camshaft 34. The variable cam timing phaser 30 includes a housing 36 disposed about an axis A and having an inner housing surface 40 defining a housing interior 42.

The variable cam timing phaser 30 also includes a rotor 44 at least partially disposed within the housing interior 42 and moveable with respect to the housing 36 between an advance position and a retard position different from the advance position. The rotor 44 includes a hub 46 and a vane 48 extending from the hub 46 away from the axis A toward the inner housing surface 40. The rotor 44 and the housing 36 define a chamber 50 that is fillable with hydraulic fluid for rotating the rotor 44 about the axis A with respect to the housing 36 between the advance and retard positions. The vane 48 is disposed in the chamber 50 and further defines and the chamber 50 into an advance chamber 52 and a retard chamber 54. It is to be appreciated that the vane 48 may separate the advance chamber 52 and the retard chamber 54 from one another such that hydraulic fluid is prevented from flowing directly between the advance chamber 52 and the retard chamber 54. It is also to be appreciated that the vane 48 may allow some hydraulic fluid to flow directly between the advance chamber 52 and the retard chamber 54.

With particular reference to FIG. 2, the variable cam timing phaser 30 also includes a control valve assembly 56. The control valve assembly 56 includes a valve housing 58 extending along the axis A and defining a valve housing interior 60. The control valve assembly 56 further includes a control piston 62 disposed in the valve housing interior 60 and moveable along the axis A between at least a first and second position with respect to the valve housing 58 to control a flow of hydraulic fluid through the valve housing interior 60. The first position of the control piston 62 may be referred to as an advance position corresponding with the advance position of the rotor 44, and the second position of the control piston 62 may be referred to as a retard position corresponding with the retard position of the rotor 44. The control piston 62 may have other positions, such as a null position between the advance and retard positions, and a full out position. The full out position typically corresponds with the predetermined position of the rotor 44. It is to be appreciated that the control piston 62 may also have any number of defined positions. Typically, the first position of the control piston 62 corresponds to the advance position of the rotor 44, and the second position of the control piston 62 corresponds to the retard position of the rotor 44. The control valve assembly 56 may also include a control sleeve 64 disposed in the valve housing interior 60 and surrounding the control piston 62.

The valve housing 58 of the control valve assembly 56 may extend along the axis A and through the rotor 44 such that the valve housing 58 is configured to be coupled to the camshaft 34. The valve housing 58 may be configured as a center bolt that couples the variable cam timing phaser 30 to the camshaft 34. The valve housing 58 may be pressed onto or coupled to the rotor 44. The valve housing 58 may be disposed outside of the rotor 44, for example mounted remotely to the engine.

With reference to FIGS. 1 and 3-13, the variable cam timing phaser 30 further includes a chamber biasing assembly 66 disposed in one of the advance chamber 52 and retard chamber 54. The chamber biasing assembly 66 is configured to bias the rotor 44 into a predetermined position between the advance and the retard positions. Specifically, when hydraulic pressure is not applied to the hydraulic fluid in the variable cam timing phaser 30 (for example, when an internal combustion engine of a vehicle is turned off), the chamber biasing assembly 66 biases the rotor 44 into a predetermined position with respect to the housing 36 between the advance and retard positions. The predetermined position that the rotor 44 settles into is a function of the biasing torque applied by the chamber biasing assembly 66. The predetermined position of the rotor 44 may be determined based on any number of factors, such as positioning the rotor 44 with respect to the housing 36 to reduce emissions upon cranking of the camshaft 34 and start-up of the internal combustion engine, as may be required by engine calibrators. Emissions may be reduced due to the chamber biasing assembly 66 allowing camshaft phasing during engine cranking. Additionally, the chamber biasing assembly 66 improves cold temperature actuation speeds and may also provide a mid-position detent function. Typically, the chamber biasing assembly 66 is configured to bias the vane 48 about the axis A, which, in turn, biases the rotor 44 about the axis A. It is to be appreciated that the vane 48 may be integral with the rotor 44 (i.e., one piece), or that the vane 48 may be a separate component from the rotor 44 (i.e., two pieces).

Figure 8A:
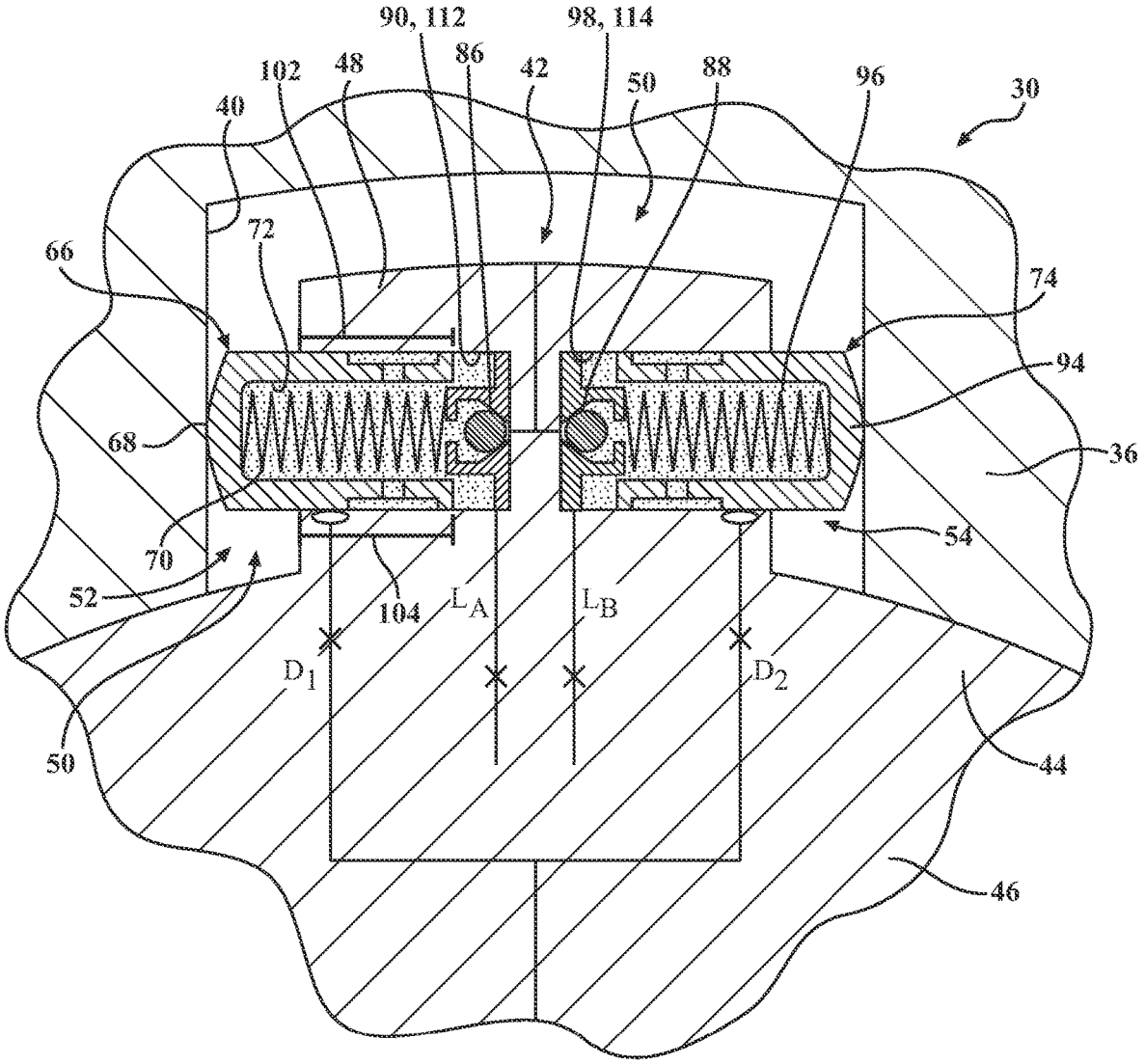
FIG. 8A is a cross-sectional view of another embodiment of the variable cam timing phaser.
Figure 8B:
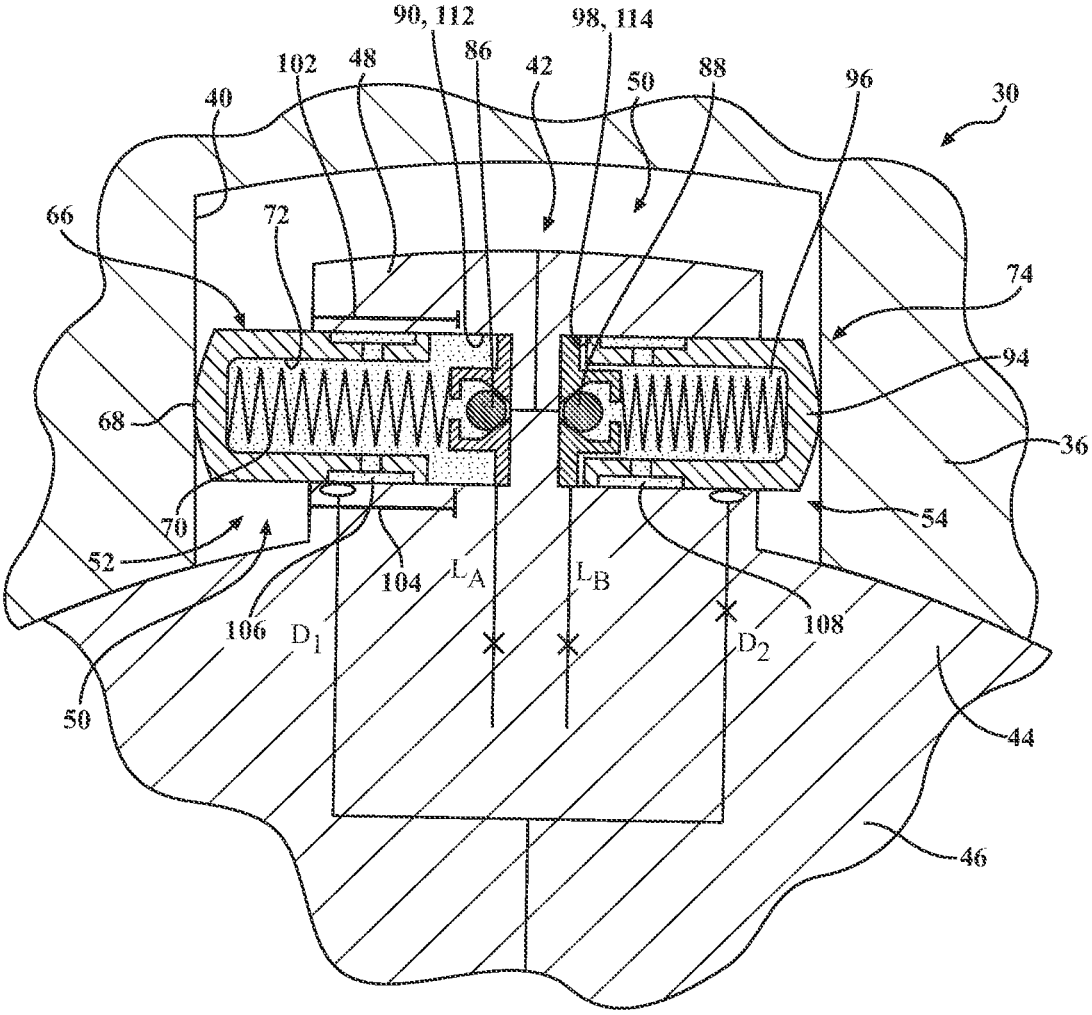
FIG. 8B is a cross-sectional view of the variable cam timing phaser of FIG. 8A, with the rotor being in an advance of mid-position.
Figure 8C:
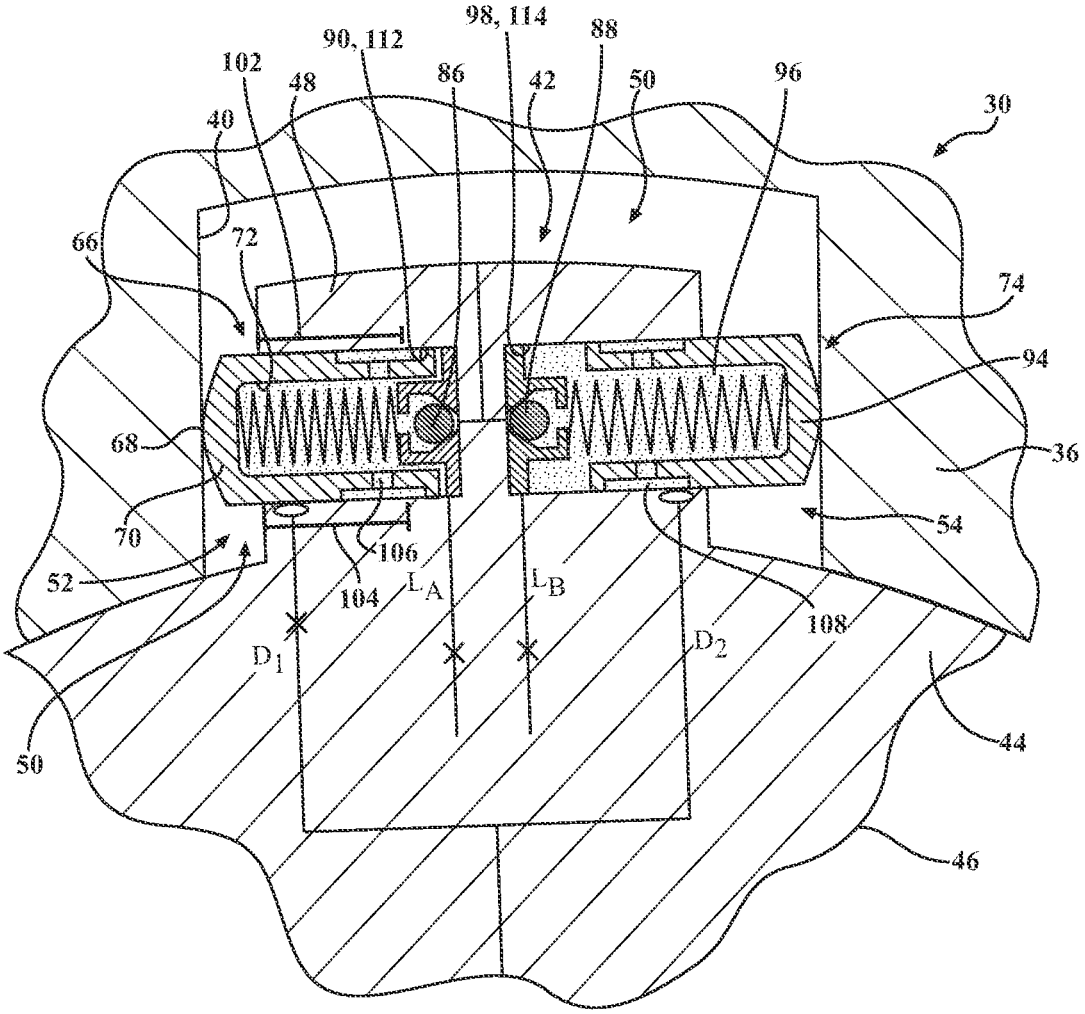
FIG. 8C is a cross-sectional view of the variable cam timing phaser of FIG. 8A, with the rotor being in a retard of mid-position.

The chamber biasing assembly 66 includes a chamber piston 68, a chamber biasing member 70, such as a spring, and a chamber check valve 86. The chamber check valve may be a ball, disc, flapper, band, and the like. In some embodiments, the chamber piston 68 may define a chamber piston interior 72, as shown in FIGS. 1, 4, 8A-8C, 10, and 11-13, with the chamber biasing member 70 disposed in the chamber piston interior 72. The chamber piston 68 may be cylindrical, circular, rectangular, or have any other suitable configuration. The chamber piston 68 may define a chamber annulus 106, as shown in FIG. 8, configured to be selectively fluidly coupled to a detent circuit D1, as shown in 8B.

Figure 12:
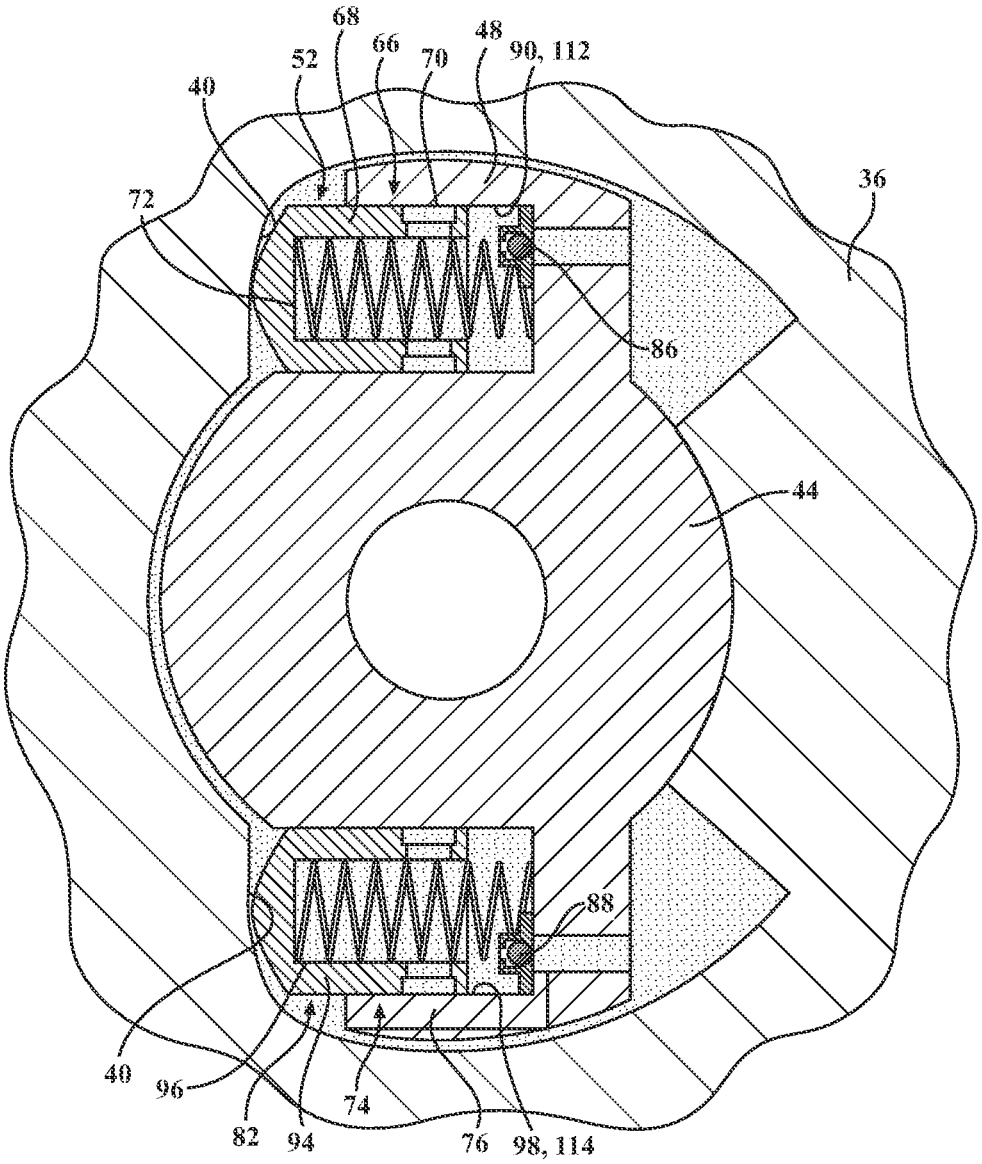
FIG. 12 is a cross-sectional view of another embodiment of the variable cam timing phaser.
Figure 13:
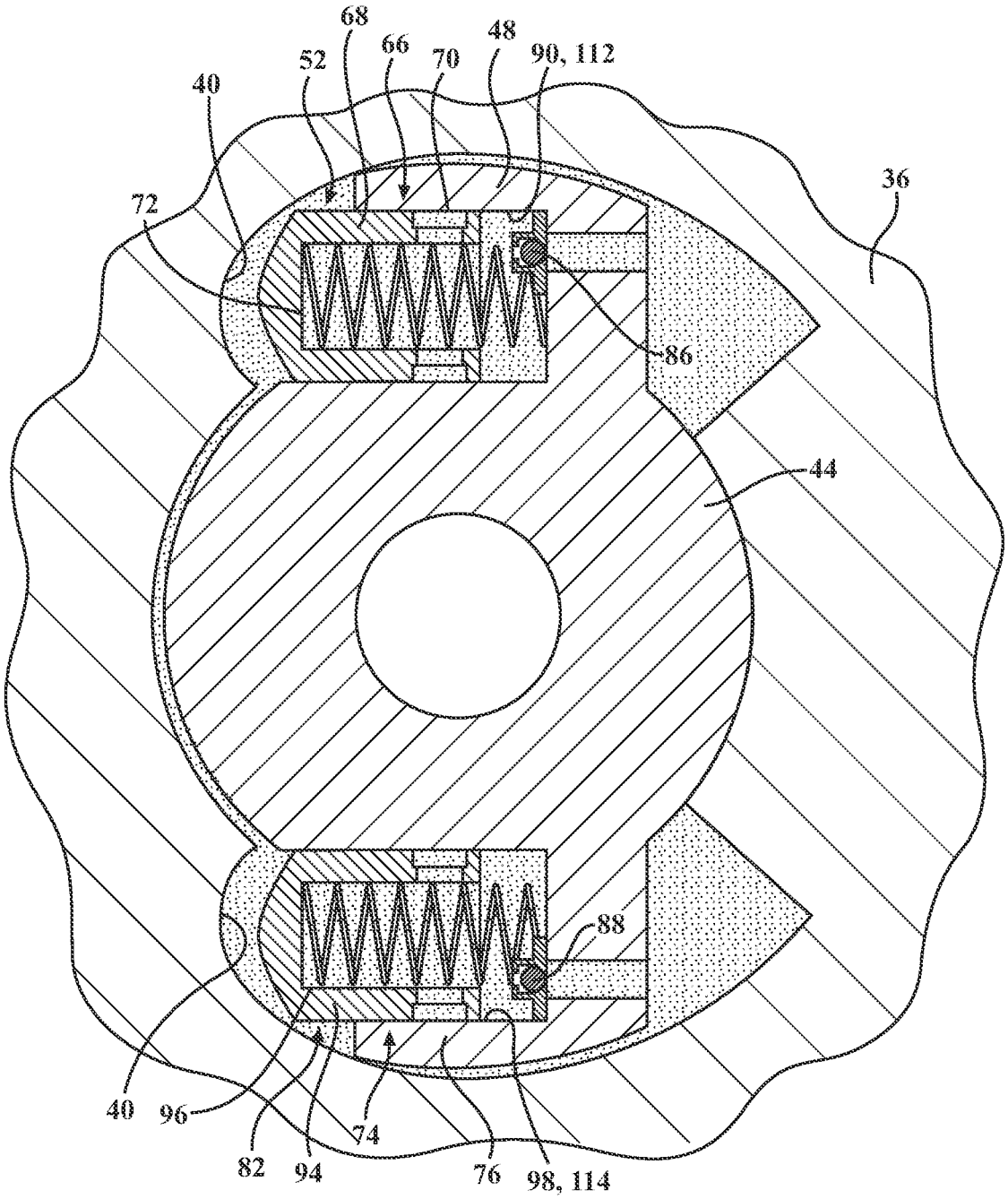
FIG. 13 is a cross-sectional view of another embodiment of the variable cam timing phaser.

The chamber piston 68 may be engageable with the inner housing surface 40. The inner housing surface 40 may have a curved configuration with respect to the vane 48. In other embodiments, the chamber piston 68 is engageable with the vane 48. It is to be appreciated that the inner housing surface 40 may have any suitable contour. For example, the inner housing surface 40 may have a constant radius, or the inner housing surface 40 may have a variable contour, as shown in FIGS. 12 and 13. An outer piston surface 110 of the chamber piston 68 may cooperate with the inner contour of the inner housing surface 40 such that a contact surface area between the chamber piston 68 and the inner housing surface is optimized.

With reference to FIGS. 1 and 3-13, the variable cam timing phaser 30 may include a second chamber biasing assembly 74 disposed in the chamber 50, with the second chamber biasing assembly 74 including a second chamber piston 68, a second chamber biasing member 96, and a second chamber check valve 88. The second chamber piston 68 may define a second chamber annulus 108, as shown in FIG. 8A-C, configured to be selectively fluidly coupled to a detent circuit D2, as shown in FIG. 8C. When in the rotor 44 position shown in FIG. 8A, the rotor 44 is in a mid-position with the chamber annulus 106 and second chamber annulus 108 being blocked off from detent circuits D1 and D2, respectively.

The chamber biasing assembly 66 may be disposed in the advance chamber 52 and the second chamber biasing assembly 74 may be in the retard chamber 54. In such embodiments, the chamber biasing assembly 66 and the second chamber biasing assembly 74 are configured to bias the rotor 44 into the predetermined position between the advance chamber 52 and the retard chamber 54. Typically, the chamber biasing assembly 66 and the second chamber biasing assembly 74 bias the rotor 44 about the axis A in opposite directions (i.e., oppose one another). The predetermined position that the rotor 44 settles is a function of the biasing torque balance between the chamber biasing assembly 66 and second chamber biasing assembly 74. Said differently, the chamber biasing assembly 66 is configured to provide a first force to the rotor 44 to bias the rotor 44 to rotate about the axis A, and the second chamber biasing assembly 74 provides a second force to the rotor 44 to bias the rotor 44 to rotate about the axis A opposite the first force.

The first force and the second force may be equal to one another such that the rotor 44 is biased into a mid-position. It is to be appreciated that if only the chamber biasing assembly 66 is present that the rotor 44 will settle at a predetermined position at the advance or retard stop. The first force and the second force may be different from one another such that the rotor 44 is biased to be in a predetermined position that is more advance or retard. The first and second force may be tuned based on the desired predetermined position of the rotor 44. For example, the swept volume and radius of chamber piston 68 and second chamber piston 94 may be adjusted, the biasing strength of the chamber biasing member 70 and second chamber biasing member 96 may be adjusted, and/or the strength of the chamber check valve 86 and the second chamber check valve 88 may be adjusted.

The rotor 44 may have a second vane 76 extending from the hub 46 away from the axis A toward the inner housing surface 40. In such embodiments, the rotor 44 and the housing 36 define a second chamber 78 that is fillable with hydraulic fluid for rotating the rotor 44 about the axis A with respect to the housing 36 between the advance and retard positions. The second vane 76 is disposed in the second chamber 78 and further defines the second chamber 78 into a second advance chamber 80 and a second retard chamber 82. As shown in FIGS. 1, 4, 10, and 11, the second chamber biasing assembly 74 may be disposed in the second chamber 78, with the second chamber biasing assembly 74 being configured to bias the rotor 44 into the predetermined position between the advance chamber 52 and the retard chamber 54. The chamber biasing assembly 66 and the second chamber biasing assembly 74 are typically tuned such that the chamber biasing assembly 66 and the second chamber biasing assembly 74 bias the rotor 44 into the predetermined position.

Due to the chamber biasing assembly 66 and, when present, the second chamber biasing assembly 74, the variable cam timing phaser 30 may be free of a locking pin for locking the rotor 44 with respect to the housing 36. Specifically, because the chamber biasing assembly 66 and, when present, the second chamber biasing assembly 74 bias the rotor 44 into the predetermined position, the biasing force provided from the chamber biasing assembly 66 and, when present, the second chamber biasing assembly 74 can be tuned such that the rotor 44 is secured in the predetermined position without the use of a lock pin, particularly when the internal combustion engine is turned off. When the variable cam timing phaser 30 is free of a lock pin, the variable cam timing phaser 30 does not have a problem faced by variable cam timing phasers including a lock pin. Specifically, when a variable cam timing phaser includes a lock pin, at times the lock pin is unable to unlock when engine oil pressure is low or is unavailable. Removing the possibility of the lock pin being unable to unlock allows the rotor 44 to move with respect to the housing 36 as soon as commanded without delay during engine cranking. The hydraulics of the variable cam timing phaser 32 prevents camshaft springs coupled to the camshaft 34 from loading the first and second chambers 50, 78 and leaking oil out of the first and second chambers 50, 78 after shutdown of the engine. Leaking oil out of chambers of a variable cam timing phaser including a lock pin is a problem faced by traditional VCT designs which have tried to simply eliminate the lock pin to overcome the un-locking problem described above. Removing the load on the hydraulic chambers after engine shutdown reduces leakdown of oil from the variable cam timing phaser 30 such that the variable cam timing phaser 30 stays full of oil. In doing so, the chamber biasing assembly 66 and, when present, the second chamber biasing assembly 74 automatically correct cam position drift after shutdown of the engine to secure the rotor 44 to the predetermined position with respect to the housing 36, which can eliminate the need for alternative correcting measures, such as an ECU, to position the rotor 44.

Similarly, due to the chamber biasing assembly 66 and, when present, the second chamber biasing assembly 74, the variable cam timing phaser 30 may be free of a torsion spring for biasing the rotor 44 with respect to the housing 36. Specifically, because the chamber biasing assembly 66 and, when present, the second chamber biasing assembly 74 bias the rotor 44 into the predetermined position, the biasing force provided from the chamber biasing assembly 66 and, when present, the second chamber biasing assembly 74 can be tuned such that the rotor 44 is secured in the predetermined position without the use of a torsion spring, particularly when the internal combustion engine is turned off.

Typically, when present, the chamber biasing assembly 66 and the second chamber biasing assembly 74 oppose one another. Specifically, the chamber biasing assembly 66 may bias the rotor 44 clockwise about the axis A toward the advance position and the second chamber biasing member 74 may bias the rotor 44 counterclockwise about the axis A toward the retard position, or vice versa.

As described above, the chamber biasing members 66, 74 may both be mounted in the same chamber (i.e., chamber 50), as shown in FIGS. 3 and 5-9, or can each be placed in separate chambers (i.e., chamber 50 and second chamber 78), as shown in FIGS. 1, 4, 10-13, for better packageability of the chamber biasing members 66, 74.

In one embodiment, as shown in FIGS. 1, 3-8C, and 11-13, the vane 48 defines a vane bore 90, with the chamber piston 68, chamber biasing member 70, and chamber check valve 86 being disposed in the vane bore 90. In such embodiments, the chamber piston 68 and the chamber check valve 86 for a pressure chamber 112 in the vane bore 90. Additionally, when present, the second vane 76 in such embodiments may define a second vane bore 98, with the second chamber piston 94, second chamber biasing member 96, and second chamber check valve 88 being disposed in the second vane bore 98. The second chamber piston 94 and the second chamber check valve 88 form a second pressure chamber 114 in the second vane bore 98. In such embodiments, the chamber piston 68 and second chamber piston 94 is biased outward by the chamber biasing member 70 and second chamber biasing member 96, respectively, against the inner housing surface 40 such that the chamber piston 68 and the second chamber piston 94 are moveable within the vane bore 90 and the second vane bore 98, respectively. The chamber piston 68 forms a pressure chamber defined by the chamber piston 68, the vane bore 90, and a chamber check valve 86 placed at the bottom of the vane bore 90. Similarly, the second chamber piston 94 forms a pressure chamber defined by the second chamber piston 94, the second vane bore 98, and a second chamber check valve 88.

Figure 9:
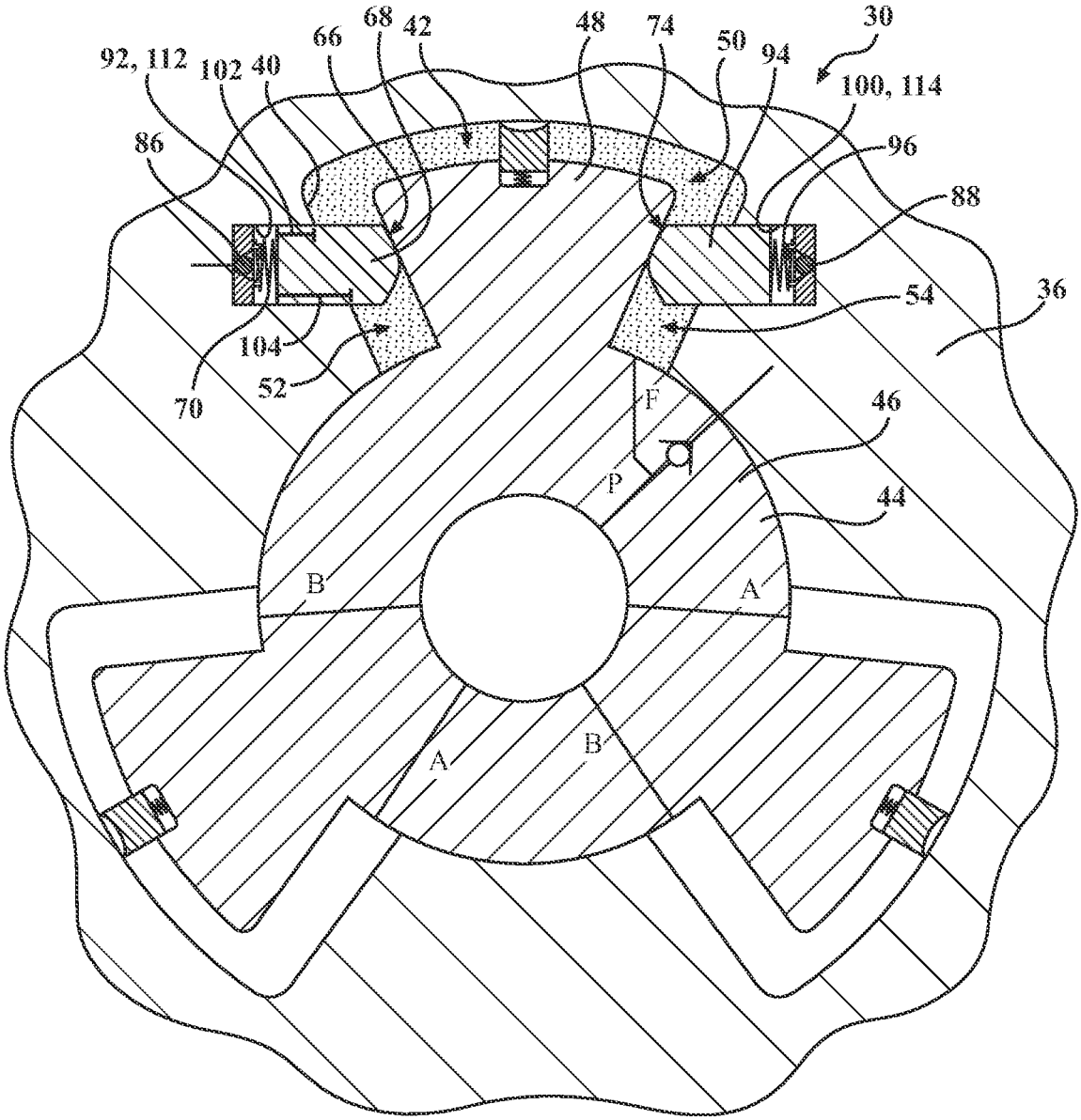
FIG. 9 is a cross-sectional view of another embodiment of the variable cam timing phaser.
Figure 10:
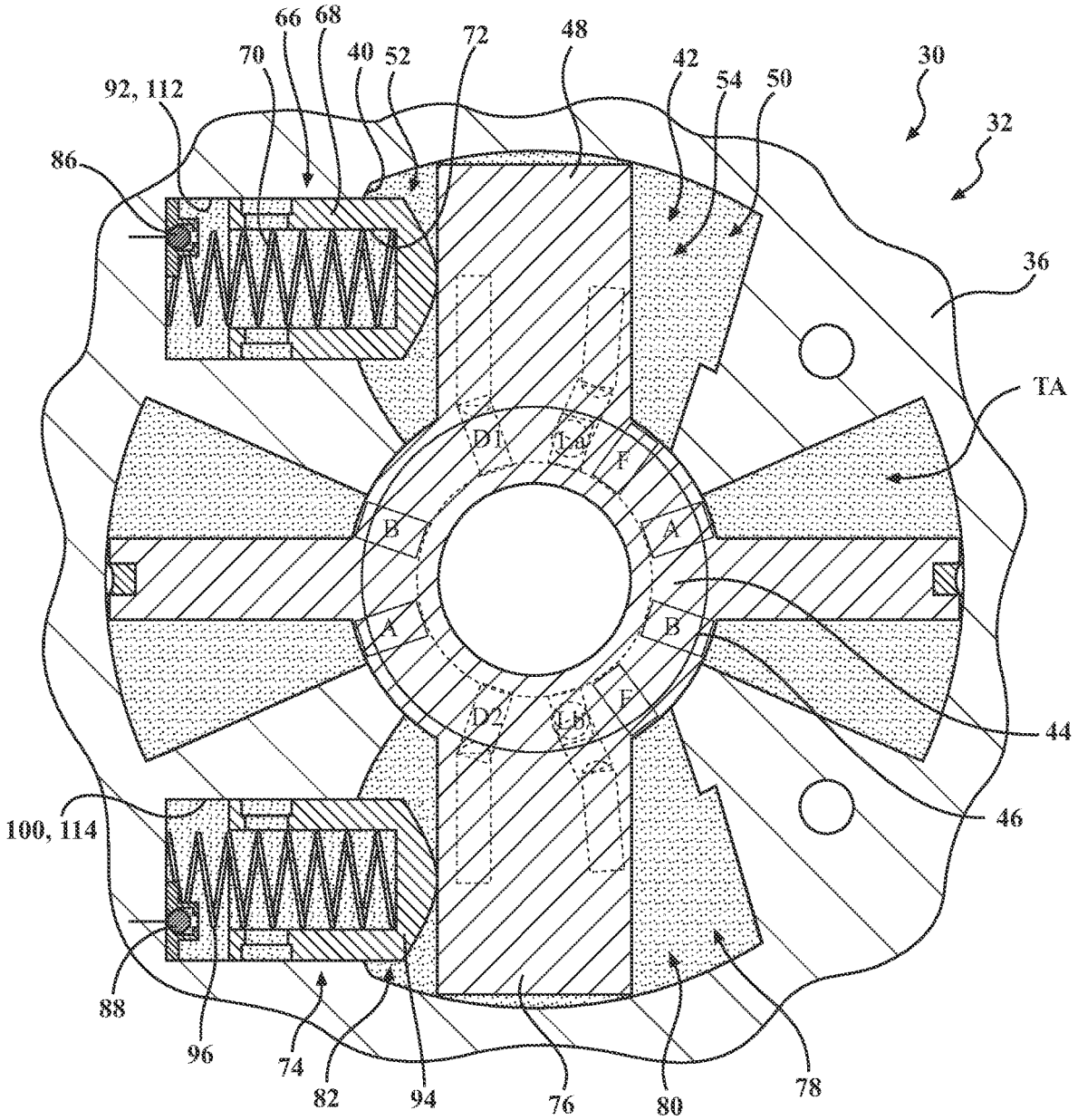
FIG. 10 is a cross-sectional view of another embodiment of the variable cam timing phaser.
Figure 11:
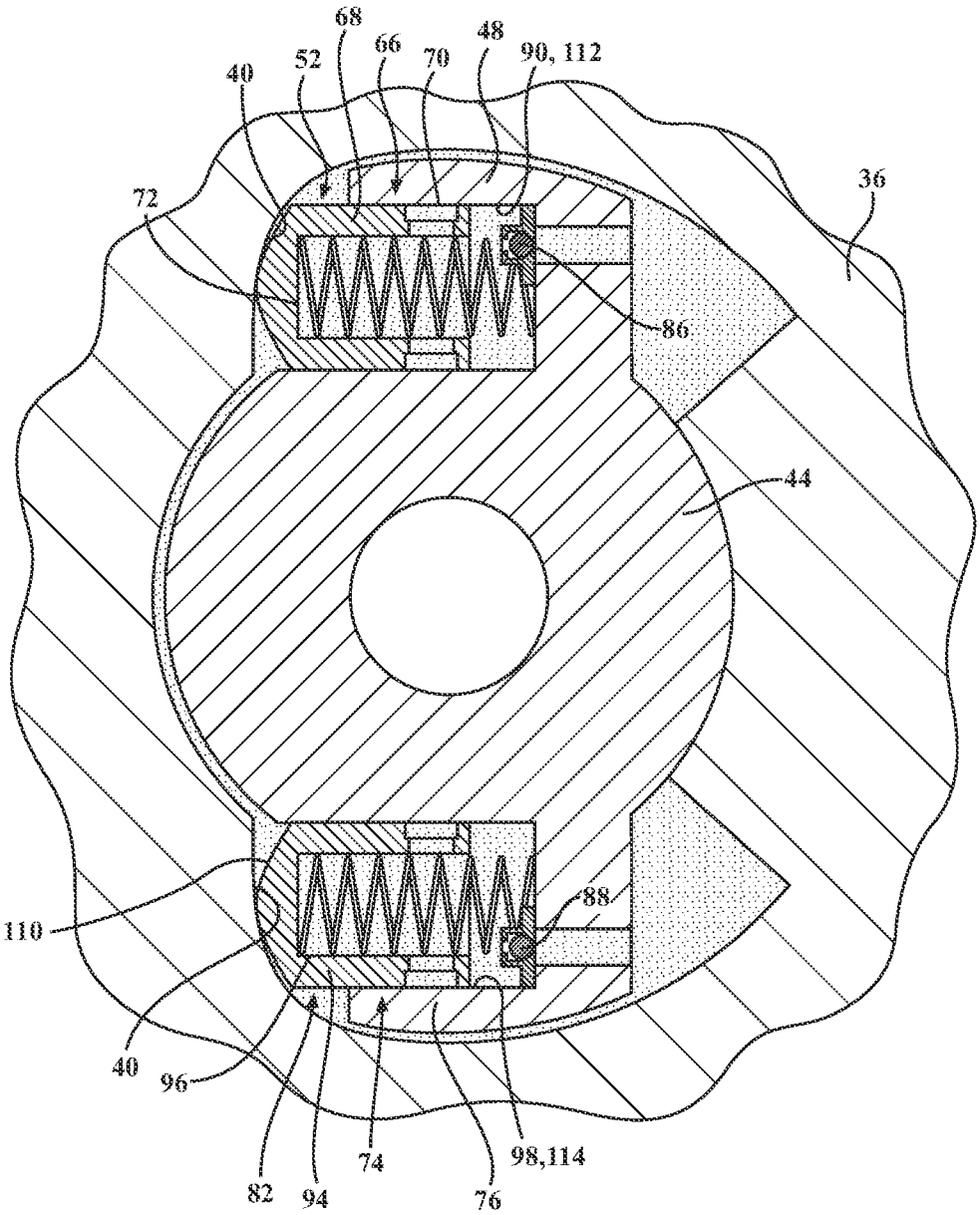
FIG. 11 is a cross-sectional view of another embodiment of the variable cam timing phaser.

As shown in FIGS. 9 and 10, the housing 36 defines a housing bore 92, with the chamber piston 68, the chamber biasing member 70, and the chamber check valve 86 being disposed in the housing bore 68. In such embodiments, the chamber piston 68 and the chamber check valve 86 form the pressure chamber 112 in the housing bore 92. As shown in FIG. 10, the chamber biasing member 70 may be disposed in the chamber piston interior 72. The chamber piston 68 may be moveable in the housing bore 68.

With reference to FIGS. 9 and 10, the housing 36 may define a second housing bore 100, with the second chamber piston 94, the second chamber biasing member 96, and the second chamber check valve 88 disposed in the second housing bore 100, with the second chamber piston 94 and the second chamber check valve 88 forming the second pressure chamber 114 in the second housing bore 100. In such embodiments, the housing bore 92 and the second housing bore 100 may be adjacent the chamber 50 and, in turn, the advance chamber 52 and the retard chamber 54, respectively, as shown in FIG. 9, or the housing bore 92 may be adjacent the chamber 50 and the second housing bore 100 may be adjacent the second chamber 80, as shown in FIG. 10.

The chamber 50 may create a fluid reservoir that the chamber piston 68 and the second chamber piston 94 can pull hydraulic oil from. Additionally, the chamber 50 and second chamber 78 may be configured to be fluidly coupled to one another to form the fluid reservoir when the control piston 62 is in a predetermined position, such as a full out position, such that the chamber piston 68 and the second chamber piston 94 are configured to draw hydraulic fluid from the fluid reservoir. The pressure chamber 112 and the second pressure chamber 114 may draw in hydraulic oil from the reservoir as needed during pumping up at each cam torque pulse. The hydraulic tune of the chamber biasing assemblies 66, 74 in relation to one another biases the rotor 44 into a predetermined position once the chamber pistons are fully pumped-up (i.e., pressure chambers are full of hydraulic oil). The pressure chambers of the chamber biasing assembly 66 and second chamber biasing assembly 74 can be hydraulically collapsed by venting them via the control valve assembly 56 as a function of the axial position of the control piston 62. The rotor 44 may define face passages and to fluidly connect the pressure chamber ports to the control valve assembly 56. On either side of the predetermined position of the rotor 44, one of the chamber piston 68 and second chamber piston 94 collapses, which homes the rotor 44 back to the predetermined position. Depending on which of the chamber piston 68 and the second chamber piston 94 is collapsed dictates if the rotor 44 moves in advance direction, retard direction, or holds in another position, such as the predetermined position. Additionally, the variable cam timing phaser 30 may include a detent circuit, which adds robustness to the predetermined position of the rotor 44 during engine cranking. When present, the face passages and drillings in the rotor 44 fluidly connect the detent ports to the control valve assembly 56. To control the flow of hydraulic fluid, the chamber piston 68 may have a first engagement land 102 and a second engagement lang 104. The first and second engagement lands 102, 104 may be the same size (i.e., same length), as shown in FIGS. 1 and 8, or the first engagement land 102 may be larger (i.e., longer length) than the second engagement land 104, or vice versa.

By using the pump action of the chamber piston 68 and second chamber piston 94 to actuate the rotor 44 of the variable cam timing phaser 30, the total swept oil volume of the variable cam timing phaser 30 can be reduced, which benefits cold performance. Additionally, the pump action of the chamber piston 68 and the second chamber piston 94, which inherently increases at cold temperatures, provides reduced reaction time during cold temperature actuation of the rotor 44. Specifically, the variable cam timing phaser 30 may change the phase of the rotor 44 during engine cranking (before the engine starts) when the engine oil supply pressure is low due to the chamber biasing member(s), which improves phasing speeds especially at colder temperatures.

For particular engine applications where the cam torque energy may not be adequate to energize the chamber pistons, the variable cam timing phaser 30 may include additional oil pressure chambers, such as torsion assist chambers or oil pressure actuated chambers, that are free of chamber biasing assemblies to supplement the chamber(s) including the chamber biasing assemblies. When present, the oil pressure chambers that are free of chamber biasing members function independently but in sync with the chamber(s) including the chamber biasing assemblies when phasing or holding the rotor 44. For example, when the control piston 62 is in the null position, all chambers of the variable cam timing phaser 30 hold the camshaft position, and on either side of the null position (i.e., axial movement of the control piston 62 from the null position) all chambers of the variable cam timing phaser 30 work to move the camshaft toward the advance or retard position. When the control piston 62 is full out, for example at shutdown of the engine, the advance and retard sides are connected to each other and to the piston reservoirs for the pressure chambers of the chamber biasing members. This allows the oil pressure chambers that are free of a chamber biasing member to not take any cam load at shutdown by free-wheeling and not leaking out their respective chamber oil. This allows the camshaft position to drift after shutdown. This also maintains oil in the variable cam timing phaser 30. Also, by connecting the oil pressure chambers that are free of a chamber biasing member to the chambers (i.e., chamber 50), the oil pressure chambers that are free of a chamber biasing member are able to supplement the reservoir capacity at start-up for the piston pump-up action until oil supply pressure can be restored to the variable cam timing phaser 30. Additionally, when present, the detent circuit is also activated when the control piston 62 is in full out position, the mid position detent circuit may robustly self-correct any drift that may have happened in the cam position after shutdown automatically as soon as cranking initiates by utilizing the pumping action of the chamber pistons to home the rotor 44 to the predetermined position.

What is claimed is:

1. A variable cam timing phaser of a variable cam timing system including a camshaft, said variable cam timing phaser comprising:

a housing disposed about an axis and having an inner housing surface defining a housing interior;

a rotor at least partially disposed within said housing interior and moveable with respect to said housing between an advance position and a retard position different from said advance position, wherein said rotor comprises a hub and a vane extending from said hub away from said axis toward said inner housing surface, with said rotor and said housing defining a chamber that is fillable with hydraulic fluid for rotating said rotor about said axis with respect to said housing between said advance and retard positions, and with said vane being disposed in said chamber and further defining said chamber into an advance chamber and a retard chamber;

a control valve assembly, comprising, a valve housing defining a valve housing interior, and a control piston disposed in said valve housing interior and between at least a first and second position with respect to said valve housing to control a flow of hydraulic fluid through said valve housing interior; and a chamber biasing assembly disposed in one of said advance and said retard chambers and configured to bias said rotor into a predetermined position between said advance and said retard positions;

wherein said chamber biasing assembly comprises a chamber piston, a chamber biasing member, and a chamber check valve; and wherein said rotor has a second vane extending from said hub away from said axis toward said inner housing surface, with said rotor and said housing defining a second chamber that is fillable with hydraulic fluid for rotating said rotor about said axis with respect to said housing between said advance and retard positions, and with said second vane disposed in said second chamber and further defining and said second chamber into a second advance chamber and a second retard chamber; and further comprising a second chamber biasing assembly comprising a second chamber piston, a second chamber biasing member, and a second chamber check valve disposed in said second chamber, and wherein said chamber biasing assembly and said second chamber biasing assembly oppose one another.

2. The variable cam timing phaser as set forth in claim 1, wherein said vane defines a vane bore, wherein said chamber piston, said chamber biasing member, and said chamber check valve are disposed in said vane bore, and wherein said chamber piston and said chamber check valve form a pressure chamber in said vane bore.

3. The variable cam timing phaser as set forth in claim 1, wherein said chamber piston defines a chamber piston interior, and wherein said chamber biasing member is disposed in said chamber piston interior.

4. The variable cam timing phaser as set forth in claim 1, wherein said chamber piston is engageable with said inner housing surface.

5. The variable cam timing phaser as set forth in claim 4, wherein said chamber piston has an outer piston surface configured to be received by a contour of said inner housing surface.

6. The variable cam timing phaser as set forth in claim 1, wherein said housing defines a housing bore, and wherein said chamber piston, said chamber biasing member, and said chamber check valve are disposed in said housing bore, and wherein said chamber piston and said chamber check valve form a pressure chamber in said housing bore.

7. The variable cam timing phaser as set forth in claim 6, wherein said chamber piston defines a chamber piston interior, and wherein said chamber biasing member is disposed in said chamber piston interior.

8. The variable cam timing phaser as set forth in claim 1, wherein said vane defines a vane bore and said second vane defines a second vane bore, wherein said chamber piston, said chamber biasing member, and said chamber check valve are disposed in said vane bore, wherein said second chamber piston, said second chamber biasing member, and said second chamber check valve are disposed in said second vane bore, wherein said chamber piston and said chamber check valve form a pressure chamber in said vane bore, and wherein said second chamber piston and said second chamber check valve form a second pressure chamber in said second vane bore.

9. The variable cam timing phaser as set forth in claim 1, wherein said housing defines a housing bore and a second housing bore, wherein said chamber piston, said chamber biasing member, and said chamber check valve are disposed in said housing bore, wherein said second chamber piston, said second chamber biasing member, and said second chamber check valve are disposed in said second housing bore, wherein said chamber piston and said chamber check valve form a pressure chamber in said housing bore, and wherein said second chamber piston and said second chamber check valve form a second pressure chamber in said second housing bore.

10. The variable cam timing phaser as set forth in claim 1, wherein said chamber and said second chamber are configured to be fluidly coupled to one another to form a fluid reservoir when said control piston is in a predetermined position such that said chamber piston and said second chamber piston are configured to draw hydraulic fluid from said fluid reservoir.

11. The variable cam timing phaser as set forth in claim 1, wherein said chamber piston defines a first engagement land and a second engagement land, wherein said first engagement land is larger than said second engagement land.

12. A variable cam timing system comprising said variable cam timing phaser as set forth in claim 1, and further comprising said camshaft.

13. A variable cam timing phaser of a variable cam timing system including a camshaft, said variable cam timing phaser comprising:

a housing disposed about an axis and having an inner housing surface defining a housing interior;

a rotor at least partially disposed within said housing interior and moveable with respect to said housing between an advance position and a retard position different from said advance position, wherein said rotor comprises a hub and a vane extending from said hub away from said axis toward said inner housing surface, with said rotor and said housing defining a chamber that is fillable with hydraulic fluid for rotating said rotor about said axis with respect to said housing between said advance and retard positions, and with said vane being disposed in said chamber and further defining said chamber into an advance chamber and a retard chamber;

a control valve assembly, comprising, a valve housing defining a valve housing interior, and a control piston disposed in said valve housing interior and between at least a first and second position with respect to said valve housing to control a flow of hydraulic fluid through said valve housing interior; and a chamber biasing assembly disposed in one of said advance and said retard chambers and configured to bias said rotor into a predetermined position between said advance and said retard positions;

wherein said chamber biasing assembly comprises a chamber piston, a chamber biasing member, and a chamber check valve; and wherein said chamber biasing assembly is disposed in said advance chamber, and further comprising a second chamber biasing assembly disposed in said retard chamber, wherein said second chamber biasing assembly comprises a second chamber piston, a second chamber biasing member, and a second chamber check valve, and wherein said chamber biasing assembly and said second chamber biasing assembly oppose one another.

14. The variable cam timing phaser as set forth in claim 13, wherein said chamber biasing assembly provides a first force to said rotor to bias said rotor to rotate about said axis, wherein said second chamber biasing assembly provides a second force to said rotor to bias said rotor to rotate about said axis opposite said first force, and wherein said first force and said second force are equal to one another.

15. The variable cam timing phaser as set forth in claim 13, wherein said chamber biasing assembly provides a first force to said rotor to bias said rotor to rotate about said axis, wherein said second chamber biasing assembly provides a second force to said rotor to bias said rotor to rotate about said axis opposite said first force, and wherein said first force and said second force are different from one another.

16. The variable cam timing phaser as set forth in claim 13, wherein said vane defines a vane bore and a second vane bore, wherein said chamber piston, said chamber biasing member, and said chamber check valve are disposed in said vane bore, wherein said second chamber piston, said second chamber biasing member, and said second chamber check valve are disposed in said second vane bore, wherein said chamber piston and said chamber check valve form a pressure chamber in said vane bore, and wherein said second chamber piston and said second chamber check valve form a second pressure chamber in said second vane bore.

17. The variable cam timing phaser as set forth in claim 13, wherein said housing defines a housing bore adjacent said advance chamber and a second housing bore adjacent said retard chamber, wherein said chamber piston, said chamber biasing member, and said chamber check valve are disposed in said housing bore, wherein said second chamber piston, said second chamber biasing member, and said second chamber check valve are disposed in said second housing bore, wherein said chamber piston and said chamber check valve form a pressure chamber in said housing bore, and wherein said second chamber piston and said second chamber check valve form a second pressure chamber in said second housing bore.

18. The variable cam timing phaser as set forth in claim 13, wherein said chamber piston defines a chamber annulus, wherein said chamber annulus is configured to be selectively fluidly coupled to a first detent circuit, wherein said second chamber piston defines a second chamber annulus, wherein said second chamber annulus is configured to be selectively fluidly coupled to a second detent circuit.

19. A variable cam timing phaser of a variable cam timing system including a camshaft, said variable cam timing phaser comprising:

a housing disposed about an axis and having an inner housing surface defining a housing interior;

a rotor at least partially disposed within said housing interior and moveable with respect to said housing between an advance position and a retard position different from said advance position, wherein said rotor comprises a hub and a vane extending from said hub away from said axis toward said inner housing surface, with said rotor and said housing defining a chamber that is fillable with hydraulic fluid for rotating said rotor about said axis with respect to said housing between said advance and retard positions, and with said vane being disposed in said chamber and further defining said chamber into an advance chamber and a retard chamber;

a control valve assembly, comprising, a valve housing defining a valve housing interior, and a control piston disposed in said valve housing interior and between at least a first and second position with respect to said valve housing to control a flow of hydraulic fluid through said valve housing interior; and a chamber biasing assembly disposed in one of said advance and said retard chambers and configured to bias said rotor into a predetermined position between said advance and said retard positions;

wherein said chamber biasing assembly comprises a chamber piston, a chamber biasing member, and a chamber check valve; and wherein said valve housing of said control valve assembly extends along said axis and extends through said rotor such that said valve housing is configured to be coupled to the camshaft.

20. A variable cam timing phaser of a variable cam timing system including a camshaft, said variable cam timing phaser comprising:

a housing disposed about an axis and having an inner housing surface defining a housing interior;

a rotor at least partially disposed within said housing interior and moveable with respect to said housing between an advance position and a retard position different from said advance position, wherein said rotor comprises a hub and a vane extending from said hub away from said axis toward said inner housing surface, with said rotor and said housing defining a chamber that is fillable with hydraulic fluid for rotating said rotor about said axis with respect to said housing between said advance and retard positions, and with said vane being disposed in said chamber and further defining said chamber into an advance chamber and a retard chamber;

a control valve assembly, comprising, a valve housing defining a valve housing interior, and a control piston disposed in said valve housing interior and between at least a first and second position with respect to said valve housing to control a flow of hydraulic fluid through said valve housing interior; and a chamber biasing assembly disposed in one of said advance and said retard chambers and configured to bias said rotor into a predetermined position between said advance and said retard positions;

wherein said chamber biasing assembly comprises a chamber piston, a chamber biasing member, and a chamber check valve; and wherein said valve housing is disposed outside of said rotor.

* * * * *